US011219989B2

(12) United States Patent
Kuo

(10) Patent No.: US 11,219,989 B2
(45) Date of Patent: Jan. 11, 2022

(54) TORQUE WRENCH

(71) Applicant: Wen-Chin Kuo, Taichung (TW)

(72) Inventor: Wen-Chin Kuo, Taichung (TW)

( * ) Notice: Subject to any disclaimer, the term of this patent is extended or adjusted under 35 U.S.C. 154(b) by 475 days.

(21) Appl. No.: 16/190,143

(22) Filed: Nov. 13, 2018

(65) Prior Publication Data

US 2020/0147770 A1 May 14, 2020

(51) Int. Cl.

| | |
|---|---|
| ***B25B 23/145*** | (2006.01) |
| *B25B 13/04* | (2006.01) |
| *B25B 13/08* | (2006.01) |
| *B25B 13/46* | (2006.01) |

(52) U.S. Cl.

CPC ..... *B25B 23/145* (2013.01); *B25B 13/04* (2013.01); *B25B 13/08* (2013.01); *B25B 13/46* (2013.01)

(58) Field of Classification Search

None

See application file for complete search history.

(56) References Cited

U.S. PATENT DOCUMENTS

| | | | | |
|---|---|---|---|---|
| 2,887,921 A * | 5/1959 | Livermont | ..... | B25B 23/1427 81/483 |
| 4,732,062 A * | 3/1988 | Grabovac | ..... | B25B 23/1427 81/478 |
| 5,859,371 A * | 1/1999 | Hsieh | ..... | B25B 23/1427 73/862.23 |

* cited by examiner

*Primary Examiner* — Brian D Keller

(57) ABSTRACT

A torque wrench includes a first part, a second part, a first spring, a block and a second spring. The first part includes a first section and a second. An axial passage is defined through the first part and a second part is received in the passage. The first part and the second part are connected to each other. The first spring is securely located in the second section. A pushing member is located in the first spring and includes a second contact portion. The block is removably in contact between the first and second contact portions. A second spring is mounted to the pushing member. The block is disengaged from the first and second contact portions when the torque wrench rotates clockwise or counter clockwise.

7 Claims, 5 Drawing Sheets

TORQUE WRENCH

BACKGROUND OF THE INVENTION

1. Fields of the Invention

The present invention relates to a torque wrench, and more particularly, to a torque wrench with simple structure and low manufacturing cost.

2. Descriptions of Related Art

A conventional torque wrench is disclosed in Taiwanese Patent Publication No. M541927, and includes a driving unit which is connected to one end of a tube and has a driving head and a connection end. The connection end is inserted into the passage of the tube. A pushing member is slidably located within the passage and connected to the connection end. A sleeve is located between the tube and pushing member. A torque adjustment unit is connected to the tube so as to adjust the torque output from the wrench. The tube needs to be treated by heat treatment to have better strength, however, t heat treatment increases the manufacturing cost. The sleeve is located between the tube and the pushing member, and more or less reinforces the strength of the wrench. The sleeve is a spring which is slidable within the tube a distance with the pushing member, therefore, the shifted sleeve cannot provide better support to the tube.

Another conventional torque wrench is disclosed in Taiwanese Patent Publication No. M556638, and has a similar structure as the Taiwanese Patent Publication No. M541927, wherein a cylindrical body is inserted into the passage of the tube and is mounted to the pushing member. The cylindrical body includes an outer surface and an inner surface. The outer surface is non-continuously in contact with the inner wall of the tube, and the inner wall of the tube is non-continuously in contact with the pushing member. Because the cylindrical body is located in the tube so that the tube is well supported by the cylindrical body, but the cylindrical body needs to be machined to have a flat cross-section so as to be non-continuously in contact with the pushing member. The extra machining to the cylindrical body causes higher manufacturing cost.

The present invention is intended to provide a torque wrench that eliminates the drawbacks mentioned above.

SUMMARY OF THE INVENTION

The present invention relates to a torque wrench and comprises a first part, a second part, a first spring, a block and a second spring. The first part includes a first section and a second. An axial passage is defined through the first part and a second part is received in the passage. The first part and the second part are connected to each other. The first spring is securely located in the second section. A pushing member is located in the first spring and includes a second contact portion. The block is removably in contact between the first and second contact portions. A second spring is mounted to the pushing member. The block is disengaged from the first and second contact portions when the torque wrench rotates clockwise or counter clockwise.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
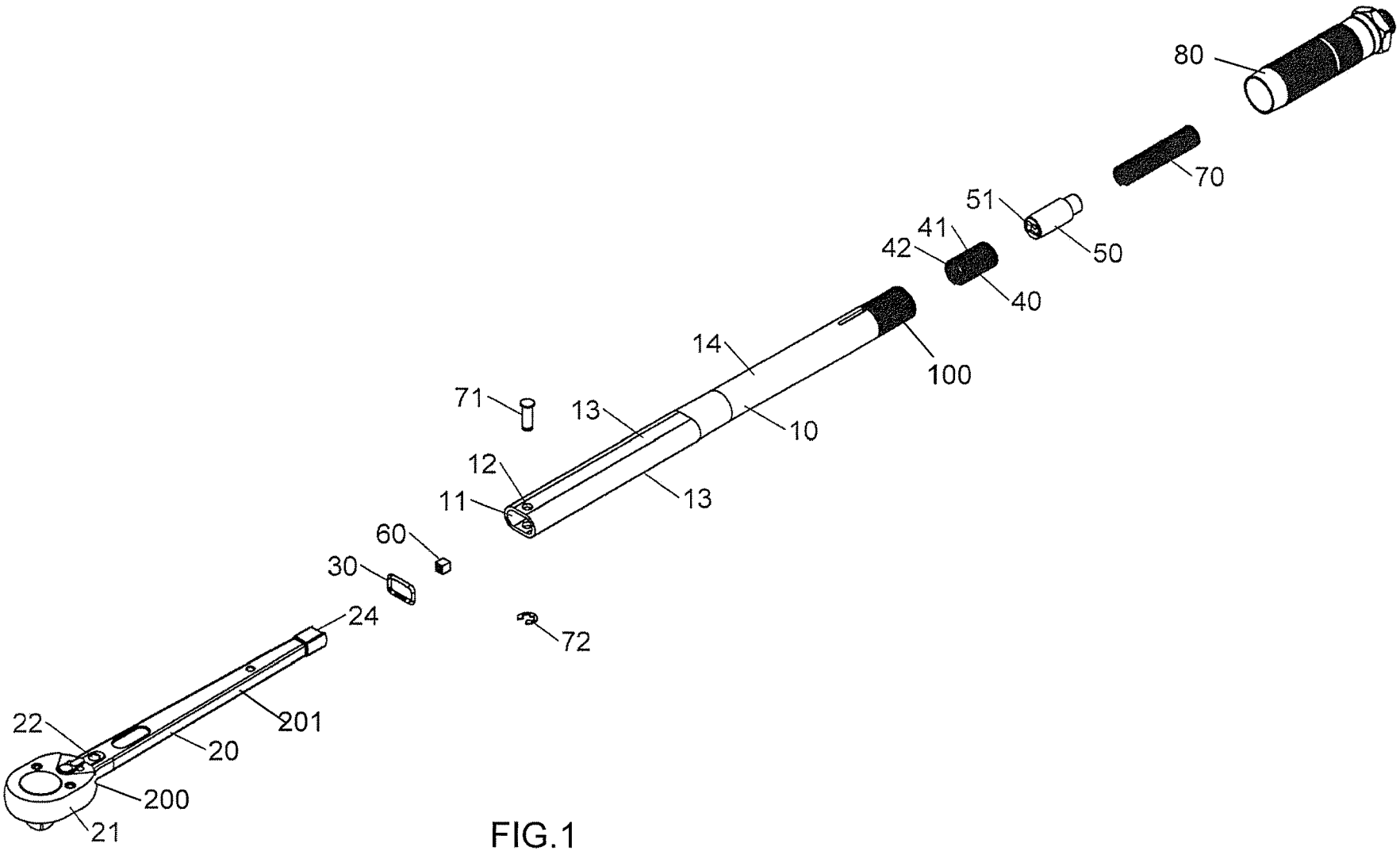
FIG. 1 is an exploded view of the torque wrench of the present invention.
Figure 3:
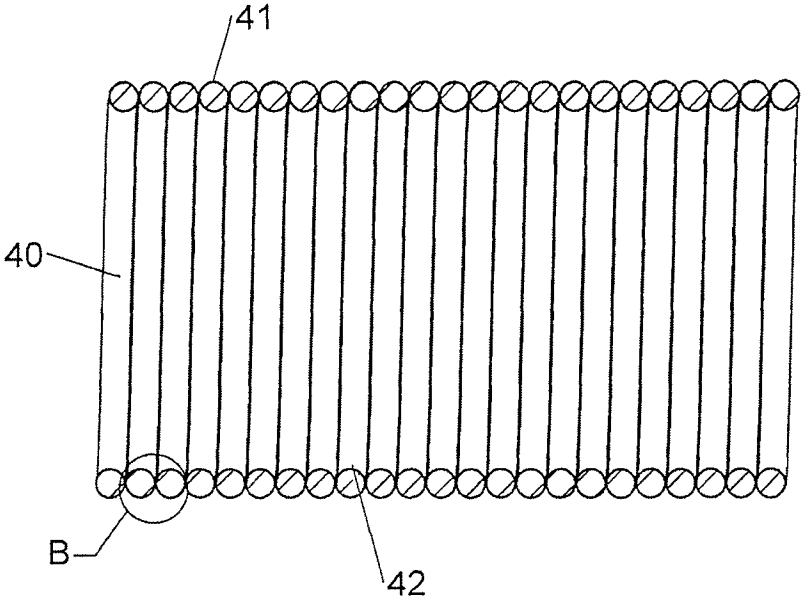
FIG. 3 is an cross sectional view, taken along line A-A of FIG. 2.

Referring to FIGS. 1 to 4, the torque wrench of the present invention comprises a first part 10 having a passage 11 defined axially therethrough. The first part 10 includes a first section 13 and a second section 14. A first hole 12 is defined transversely through the first section 13 and located close to an open end of the first section 13. The second section 14 has a threaded section 100 formed on an open end thereof. A grip 80 is threadedly connected to the threaded section 100.

A second part 20 includes head portion 200 and a tail portion 201, wherein the tail portion 201 is inserted into the passage 11 from the open end of the first section 13. A second hole 22 is defined transversely through the head portion 200 and a pin 71 extends through the first and second holes 22 to connect the second part 20 to the first part 10. A C-shaped clip 72 is engaged with the pin 71 to restrict the pin 71 from disengaging from the first and second holes 12, 22, so that the first and second parts 10, 20 are not separated from each other. The first section 13 is an elongate cross section and includes a top flat face and a bottom flat face, and two curved latera faces are formed between the top flat face and the bottom flat face. The second section 14 is a circular tube and has a tapered section which is connected to the first section 13.

A driving part 21 is formed to the head portion 200 and located beyond the first part 10. The driving part 21 is a ratchet driving part, box-end wrench head or an open-end wrench head. The tail portion 201 includes a first contact portion 24 which is a recessed area defined in the distal end of the tail portion 201 and located in the second section 14. A ring 30 is mounted to the second part 20 and located between the driving part 21 and the second hole 22 so as to seal the open end of the first section 13 when the tail portion 201 is inserted into the first section 13.

Figure 4:
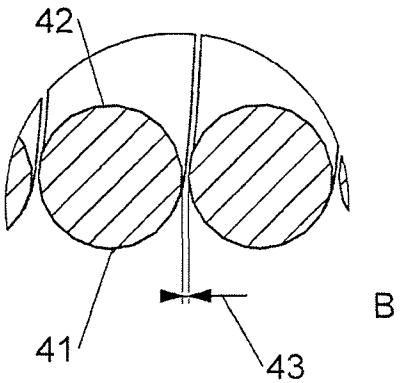
FIG. 4 is an enlarged view of the circled portion "B" in FIG. 3.
Figure 2:
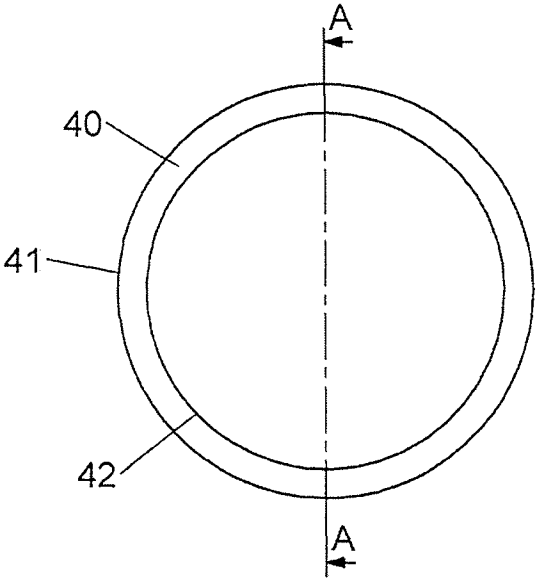
FIG. 2 is a front view of the first spring of the torque wrench of the present invention.
Figure 5:
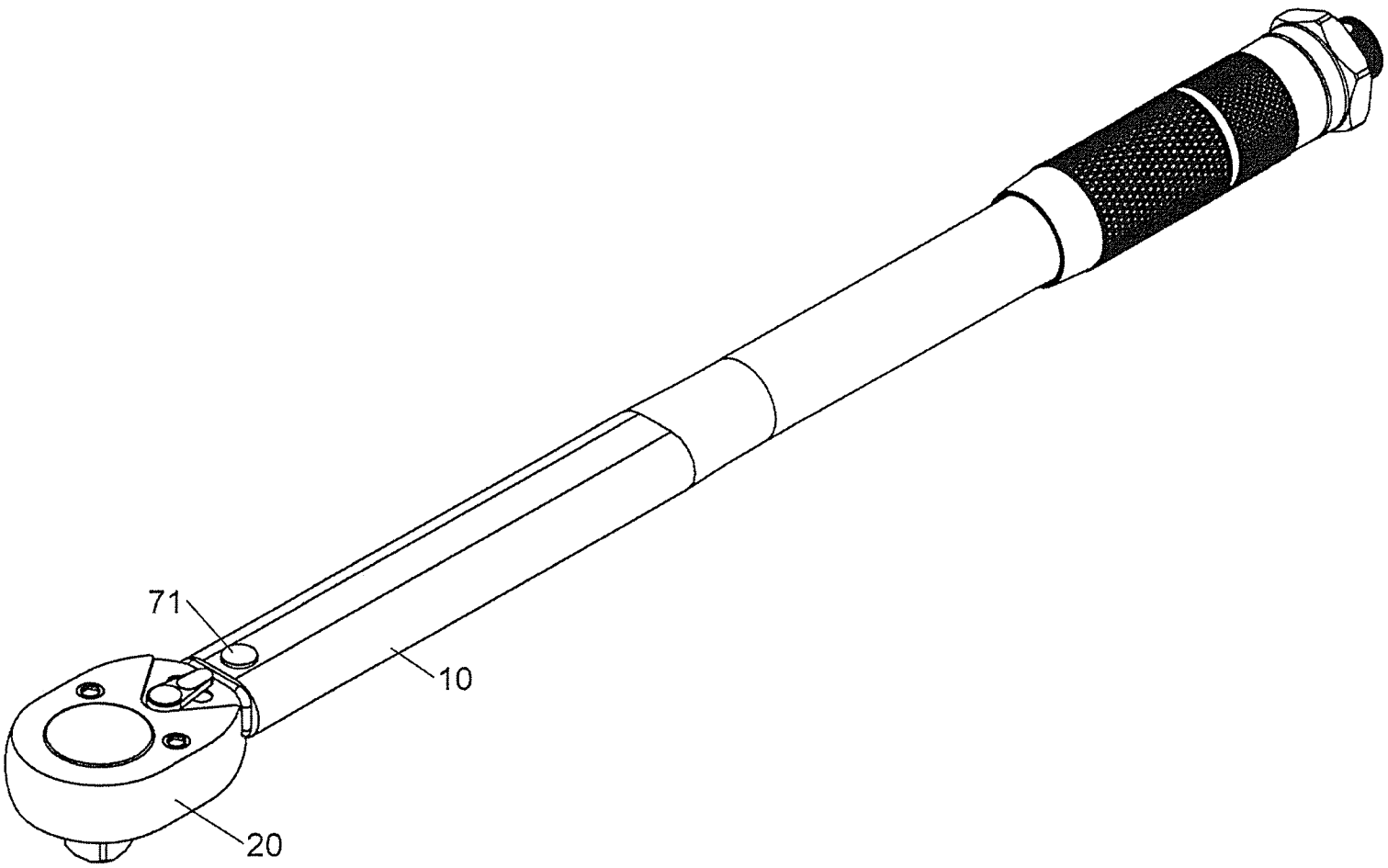
FIG. 5 is a perspective view to show the torque wrench of the present invention.
Figure 6:
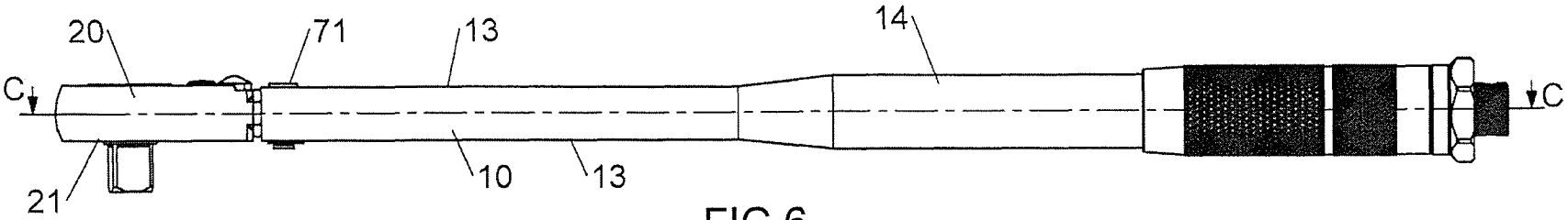
FIG. 6 is a side view of the torque wrench of the present invention.
Figure 7:
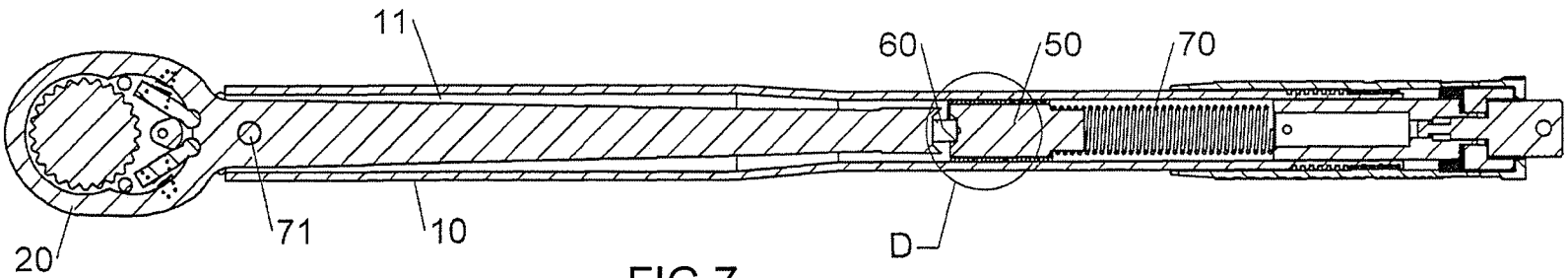
FIG. 7 is an cross sectional view, taken along line C-C of FIG. 6.

A first spring 40 has an outer surface 41 and an inner surface 42, wherein the outer surface 41 securely engaged with the inner periphery of the second section 14. The first spring 40 is a compression spring ring includes multiple spiral portions which are spaced by a gap. The outer surface 41 of the first spring 40 contacts the inner periphery of the second section 14 by multiple contact points spaced by the gaps. The inner surface 42 contacts the outer periphery of the pushing member 50 by multiple contact points spaced by the gaps as shown in FIG. 4.

A pushing member 50 is movably located within the first spring 40. That is to say, there is space between the inner surface 42 of the first spring 40 and the outer periphery of the pushing member 50. The pushing member 50 has a second contact portion 51 defined in the first end thereof, and the second contact portion 51 is located corresponding to the first contact portion 24. A first viscous liquid is filled between the inner periphery of the second section 14 and the outer surface 41 of the first spring 40. A second viscous liquid filled between an outer periphery of the pushing member 50 and the inner surface 42 of the first spring 40. The viscosity of the first viscous liquid and the viscosity of the second viscous liquid are different.

A block 60 is located in the second section 14 and in contact between the first and second contact portions 24, 51. The block 60 is rectangular block. A second spring 70 is located in the second section 14 and contacts the second end of the pushing member 50. The second spring 70 is biased between the grip 80 and the pushing member 50. When the grip 80 is rotated, the compression status of the second spring 70 is adjusted so as to obtain different torque.

Figure 8:
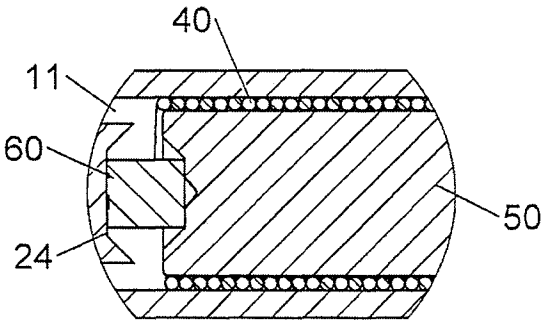
FIG. 8 is an enlarged view of the circled portion "D" in FIG. 7.
Figures 9, 10:
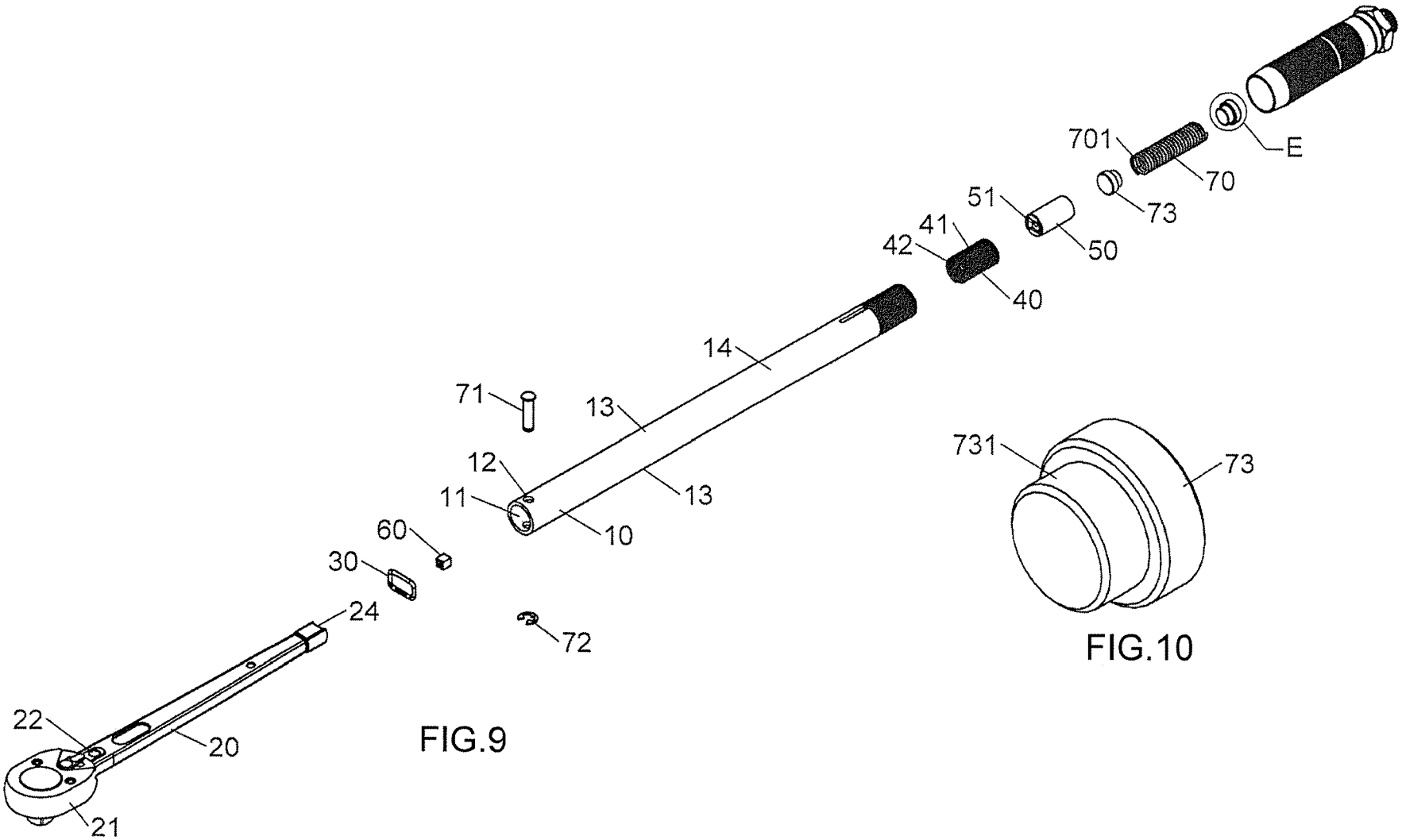
FIG. 9 is an exploded view of the second embodiment of the torque wrench of the present invention.
FIG. 10 is an enlarged view of the circled portion "E" in FIG. 9.

FIGS. 9 and 10 show that when the cross section of the first section 13 is a circular cross section, the second part 20 is also has a circular cross section. As shown in FIGS. 1 and 8, when the cross section of the first section 13 is an elongate oval-shaped cross section, the second part 20 is also has an elongate oval-shaped cross section.

The first section 13 and the second section 14 have an identical cross section. The first and second contact portions 24, 51 are symmetrical to each other. The block is disengaged from the first and second contact portions when the torque wrench rotates clockwise or counter clockwise.

The second section 14 includes an oval cross section which presses the outer surface 41 of the first spring 40 so as to securely engage the outer surface 41 of the first spring 40 with the inner periphery of the second section 14.

The second spring 70 includes an outer periphery 701, and two end pieces 73 are connected to two ends of the second spring 70. Each end piece 73 includes a tubular portion 731. The diameter of the outer periphery 701 is larger than that of each tubular portion 731, so that the two tubular portions 731 are inserted into the two ends of the second spring 70.

The torque wrench includes advantages such as that the first spring 40 is secured in the second section 14, and the outer surfaced 41 of the first spring 40 is secured to the inner periphery of the second section 14 so that the first spring 40 is not slidable in the second section 14 so as to support the second section 14.

The first spring 40 is a spring which is not an expensive part, and can be treated by heat treatment to have better strength to support the second section 14.

The first spring 40 is a compression spring ring includes multiple spiral portions which are spaced by a gap, so that the outer surface 41 of the first spring 40 contacts the inner periphery of the second section 14 by multiple contact points which generate less friction. In other words, the first spring 40 can be easily installed into the second section 14.

While we have shown and described the embodiment in accordance with the present invention, it should be clear to those skilled in the art that further embodiments may be made without departing from the scope of the present invention.

What is claimed is:

1. A torque wrench comprising:

a first part having a passage defined axially therethrough, the first part including a first section and a second section, a first hole defined transversely through the first section and located close to an open end of the first section, the second section having a threaded section formed on an open end thereof, a grip threadedly connected to the threaded section;

a second part having head portion and a tail portion, the tail portion inserted into the passage from the open end of the first section, a second hole defined transversely through the head portion and a pin extending through the first and second holes to connect the second part to the first part, a driving part formed to the head portion and located beyond the first part, the tail portion including a first contact portion which is a recessed area defined in a distal end of the tail portion and located in the second section;

a ring mounted to the second part and located between the driving part and the second hole so as to seal the open end of the first section when the tail portion is inserted into the first section;

a first spring having an outer surface and an inner surface, the outer surface securely engaged with an inner periphery of the second section, the first spring being a compression spring ring;

a pushing member movably located within the first spring, the pushing member having a second contact portion defined in a first end thereof, the second contact portion located corresponding to the first contact portion; wherein the first spring including multiple spiral portions which are spaced by a gap, the outer surface of the first spring contacting the inner periphery of the second section by multiple contact points spaced by the gaps, the inner surface contacting the outer periphery of the pushing member by multiple contact points spaced by the gaps;

a first viscous liquid filled between the inner periphery of the second section and the outer surface of the first spring, a second viscous liquid filled between an outer periphery of the pushing member and the inner surface of the first spring;

a block located in the second section and being in contact between the first and second contact portions;

a second spring located in the second section and contacting a second end of the pushing member, and a clip engaged with the pin to restrict the pin from disengaging from the first and second holes.

2. The torque wrench as claimed in claim 1, wherein the first section includes a top flat face and a bottom flat face, and two curved lateral faces are formed between the top flat face and the bottom flat face, the second section is a circular tube and has a tapered section which is connected to the first section, the clip is a C-shaped clip.

3. The torque wrench as claimed in claim 1, wherein the driving part is a ratchet driving part, box-end wrench head or an open-end wrench head.

4. The torque wrench as claimed in claim 1, wherein the block is a rectangular block.

5. The torque wrench as claimed in claim 1, wherein the second spring is biased between the grip and the pushing member, when the grip is rotated, a compression status of the second spring is adjusted so as to obtain different torque.

6. The torque wrench as claimed in claim 1, wherein the first and second contact portions are symmetrical to each other, the block is disengaged from either of the first and second contact portions when the torque wrench rotates clockwise or counter clockwise.

7. The torque wrench as claimed in claim 1, wherein the viscosity of the first viscous liquid and the viscosity of the second viscous liquid are different.

* * * * *